US006152583A

United States Patent [19]

Langner

[11] Patent Number: 6,152,583

[45] Date of Patent: Nov. 28, 2000

[54] ADJUSTABLE LUMINAIRE HAVING PIVOTABLE LAMP AND REFLECTOR ASSEMBLY

[75] Inventor: Alejandro-Mier Langner, Providence, R.I.

[73] Assignee: Genlyte Thomas Group LLC, Louisville, Ky.

[21] Appl. No.: 09/027,146

[22] Filed: Feb. 20, 1998

[51] Int. Cl.[7] ..... F21S 8/00

[52] U.S. Cl. ..... 362/427; 362/147; 362/220; 362/269; 362/277; 362/319

[58] Field of Search ..... 362/806, 84, 138, 362/265, 220, 263, 287, 418, 217–221, 269–277, 296–310, 362–372, 457, 319, 801, 427, 147–151, 226, 281, 295, 449; 313/493

[56] References Cited

U.S. PATENT DOCUMENTS

| | | | |
|---|---|---|---|
| 2,913,570 | 11/1959 | Gough et al. | 362/304 |
| 3,259,739 | 7/1966 | Guth | 362/217 |
| 3,944,810 | 3/1976 | Grindle | 362/297 |
| 4,138,713 | 2/1979 | Szpur | 362/218 |
| 4,417,300 | 11/1983 | Bodmer | 362/304 |
| 4,447,865 | 5/1984 | Van Horn et al. | 362/305 |
| 4,545,000 | 10/1985 | Fraley et al. | 362/304 |
| 4,654,758 | 3/1987 | Székács | 362/516 |
| 5,029,057 | 7/1991 | Devir et al. | 362/226 |
| 5,130,910 | 7/1992 | Engel | 362/217 |
| 5,381,322 | 1/1995 | Humphreys | 362/220 |
| 5,477,443 | 12/1995 | Cvek | 362/413 |
| 5,613,766 | 3/1997 | Raouf | 362/287 |

*Primary Examiner*—Sandra O'Shea
*Assistant Examiner*—Ismael Negron

[57] ABSTRACT

A lighting fixture or luminaire in which a multi-tube fluorescent lamp may be oriented in a horizontal position while focusing the omnidirectional output from the lamp. A swivel assembly enables the lamp to move as a single unit with the reflector housing, thereby to maintain the alignment of the lamp tube to the reflector surface while allowing aiming of the light beam. In one embodiment of the invention, a socket housing snap fits into the reflector housing so that the lamp rotates simultaneously with the reflector housing. The beam spread delivered by the luminaire has a bright center and a soft perimeter so that the bright center may be used as accent lighting and the peripheral light may be used for soft general lighting.

8 Claims, 5 Drawing Sheets

ADJUSTABLE LUMINAIRE HAVING PIVOTABLE LAMP AND REFLECTOR ASSEMBLY

BACKGROUND OF THE INVENTION

The invention relates generally to lighting fixtures and luminaires, and more particularly to a compact fluorescent lighting fixture for use, for example, in producing a relatively intense beam in a low-cost and efficient manner.

It is often desired, such as in retail establishments, to produce accent lighting in which a relatively high-intensity beam is directed onto a display area in the store or the like to highlight the displayed article. The beam of bright light is desirably surrounded by a penumbra or perimeter of relatively low or soft intensity light which provides a muted contrast with the central, relatively bright beam.

Currently, a lighting designer seeking to achieve suitable accent lighting is generally limited to the use of a metal-halide or halogen lamp as the fixture's light source. These light sources are, however, either relatively expensive to purchase or to operate. Further, halogen lamps have relatively short operating lives that require their frequent and costly replacement. Fluorescent lighting has long been known as a means to provide an efficient and less expensive alternative to metal halide, halogen and other light sources. However, there is not at this time a reliable or effective lighting fixture or luminaire that employs a fluorescent light source which can be effectively used to provide accent lighting.

Most of the existing compact fluorescent lighting products are known as "wall washers" or wide floods that are typically used to produce asymmetrical beams, which are not appropriate for accent lighting or to illuminate objects away from the walls. Because of their relatively lower light output, the fluorescent lighting sources that have been previously used in an attempt to produce accent lighting have used multiple lamps. The reflector that is needed to work with a multi-lamp fluorescent system to yield a minimum acceptable light output, however, has been found to require a large-scale fixture that is difficult to work with in the relatively small architectural spaces currently available to lighting designers.

Recently developed triple-tube fluorescent sources, because of their more powerful light output, now allow the use of a fluorescent lamp with a single lamp reflector to provide a sufficient light output necessary to achieve the desired accent light pattern. However, as a result of their elongated shape, triple-tube fluorescent tubes remain difficult to use to produce accent lighting and particularly to achieve the highly efficient light output from the smallest, aesthetically pleasing reflector.

SUMMARY OF THE INVENTION

It is accordingly an object of the invertion to provide an energy-efficient, compact luminaire for use in providing accent lighting.

It is a further object of the invention to provide a luminaire of the type desired using a compact fluorescent light source.

It is a further object of the invention to provide a luminaire of the type described in which a fluorescent light source can be accurately positioned with regard to a reflector to provide a symmetrical beam spread having a high-intensity central region surrounded by relatively low intensity perimeter.

To these ends, the luminaire of the invention includes an optical system that achieves increased efficiency by arranging the fluorescent tube in a horizontal position while focusing the omnidirectional output from the lamp to create a relatively intense light beam. The reflector and fluorescent lamp assembly of the luminaire are mounted to the ballast housing by means of a swivel assembly which enables the lamp to move as a single unit with the reflector, thereby to maintain the desired optical alignment of the lamp to the reflector surface while aiming the light beam. This is achieved, in one aspect of the invention, through the use of a socket housing secured in a tight snap fit with the reflector so that the reflector rotates together with the socket housing and the lamp rotates simultaneously with the reflector, thereby maintaining the position of the lamp relative to the reflector optically correct. The beam spread delivered by the reflector has a bright center and a soft perimeter; the bright center may be used for accent lighting and the peripheral spill light may be used to provide soft general lighting.

The reflector of the luminaire of the invention is optically designed for use with a horizontal position of the light source, so as to expose the largest possible surface area of the light source tube toward the opening of the reflector in order to obtain the most direct light output from the light source before it bounces off the reflector surface. In a further aspect of the invention, the inner surface of the reflector is divided into a plurality of sections with different surface reflective finishes. In the embodiment of the invention described herein, two of the sections are highly specular to maximize the light output, and the other two are semispecular so as to diffuse the light and fill the dark spots.

BRIEF DESCRIPTION OF THE DRAWINGS

To the accomplishment of the above and to such further objects as may hereinafter appear, the present invention relates to a luminaire as defined in the appended claims as considered together with the following detailed description and the accompanying drawings, in which:

DESCRIPTION OF THE PREFERRED EMBODIMENT

Figure 1:
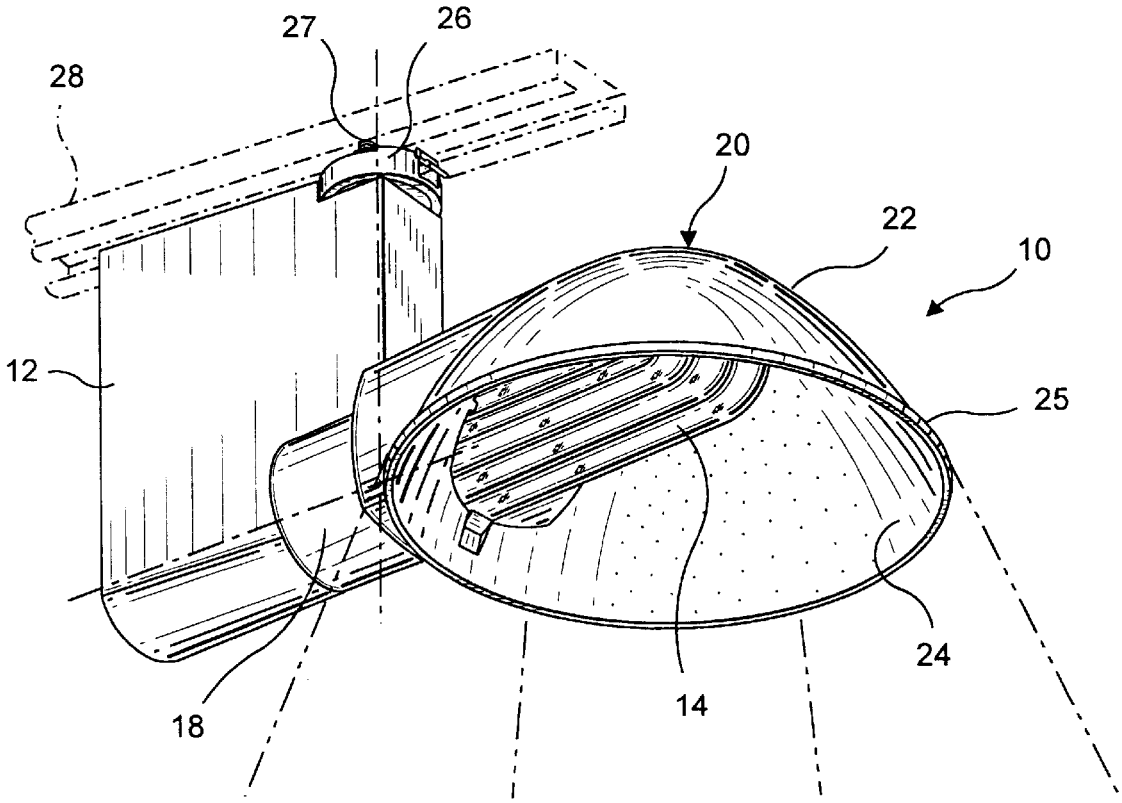
FIG. 1 is a perspective view of a luminaire in accordance with a preferred embodiment of the invention.

As seen in FIG. 1, the luminaire or lighting fixture of the present invention, in accordance with a preferred embodiment, as generally designated 10, provides a soft-edge symmetrical beam that includes a relatively intense central conical beam which can be used to advantage for accent lighting, surrounded by a relatively less intense, soft surrounding general light. Lighting fixture 10 includes a ballast housing 12, which contains a conventional electronic ballast circuit (not shown) for operation of a fluorescent light source.

In the embodiment of the invention herein described, the light source is in the form of a U-shaped triple-tube fluorescent lamp 14 that is mounted to and within a reflector housing 20. One end of socket housing 18 is secured to the open end of the neck portion of reflector housing 20 and its other end is mounted for rotation to ballast housing 12.

Reflector housing 20 includes an outer, non-reflecting surface 22 made e.g. of a plastic material, and an inner metallic reflective surface 24 disposed about lamp 14. Lamp 14 is disposed in a substantially horizontal orientation, that is, about the horizontal axis of the reflector housing 20. Reflector housing may, as shown, include a peripheral bead 25 at its lower end to add rigidity to the reflector housing and to hold an accessory such as a louver.

If it is intended to employ the luminaire of the invention in a ceiling track lighting system, a cylindrical adapter fitting 26 may, as shown, be pivotally mounted to an upper corner of the ballast housing 12. Adapter 26 is adapted to engage a conventional ceiling track assembly shown schematically at 28. The adapter fitting 26 allows the ballast housing 12 and fixture 10 to rotate through an angle of 245° about the central vertical axis of the adapter.

Adapter fitting 26 also includes an electrical contact 27 for electrically connecting the track power line to the ballast circuit within ballast housing 12 from which wires extend to lamp contacts 16 (FIG. 6) to energize the lighting fixture. It is to be understood that the lighting fixture of the invention is not limited to use with a track lighting system but may also be used to advantage, for example, in other accent lighting installations, such as in a wall-mounted or recessed lighting installation.

Figure 2:
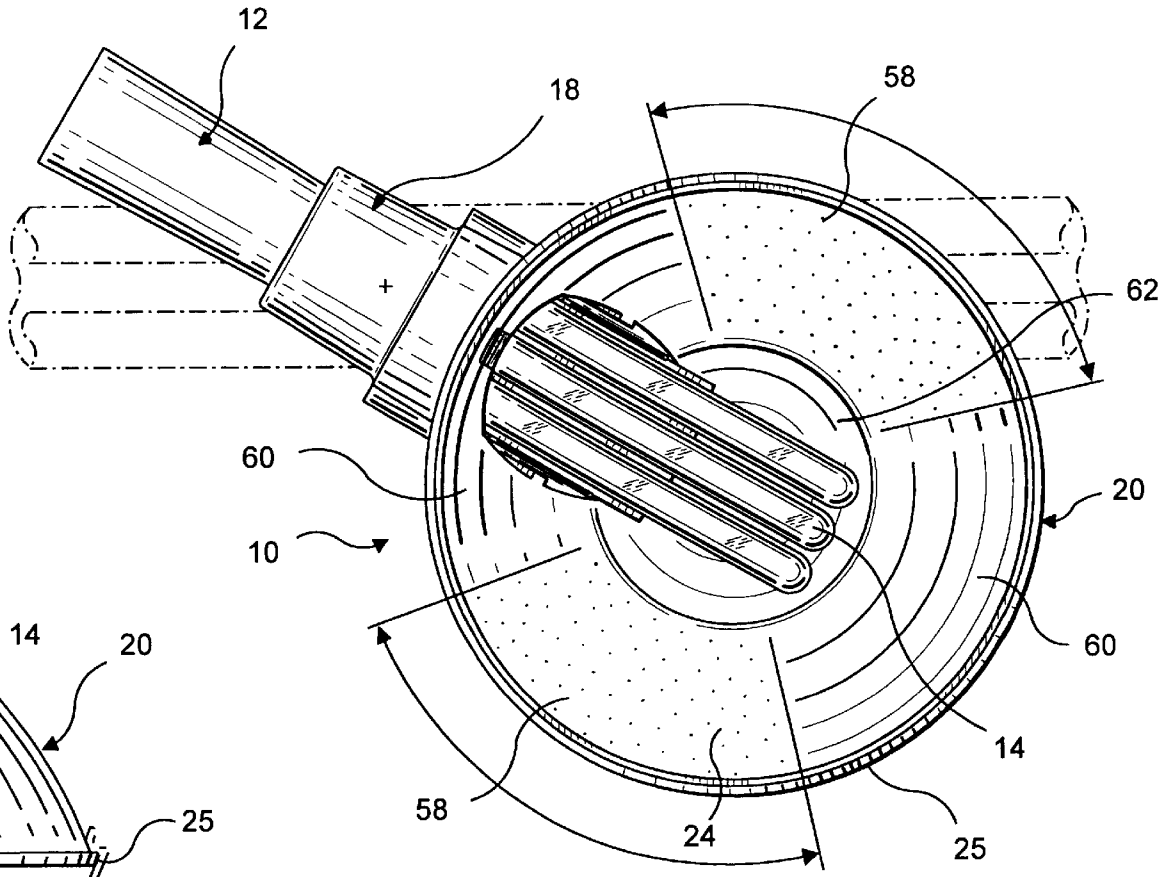
FIG. 2 is a bottom elevation of the luminaire of FIG. 1.
Figure 3:
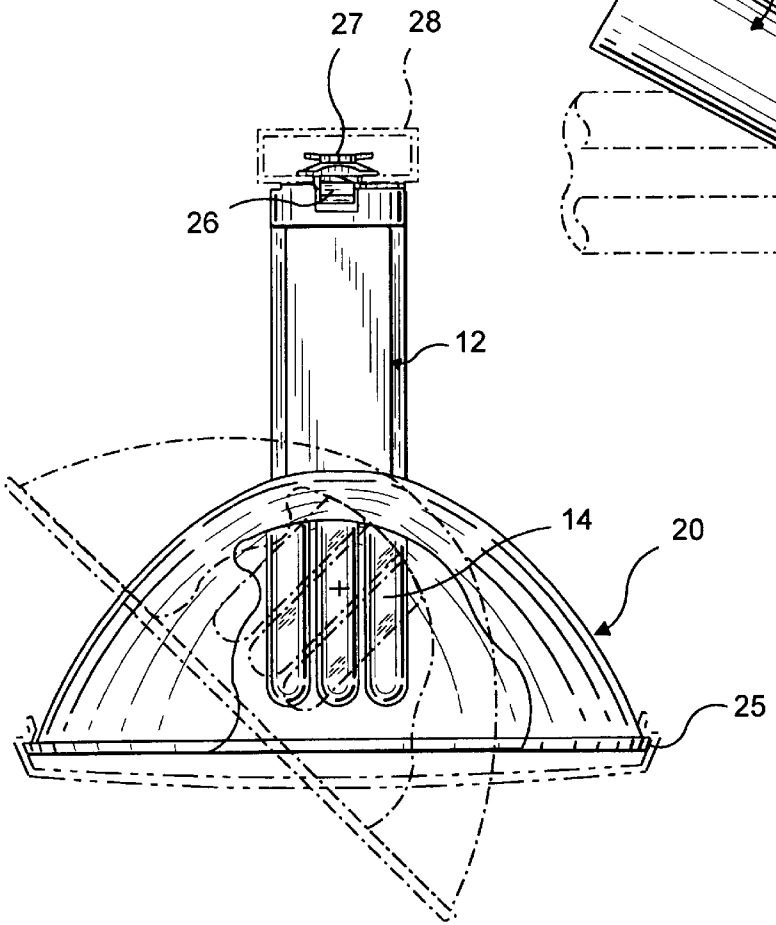
FIG. 3 is a side elevation, partly broken away, of the luminaire of the invention as affixed to a track illuminating system showing two possible positions of the reflector relative to the ballast housing.

The free end of the socket housing 18 is dimensioned and shaped to match the inside cross-section of the neck of reflector housing 20. When the free end of socket housing is inserted into the reflector housing 20, as described below, a tight, hardwareless snap fit between the reflector housing 20 and socket housing 18 is established. The other end socket housing 18 is secured to a wall of ballast housing 12, in a manner described below, which allows the socket housing 18 to rotate relative to the ballast housing. This arrangement allows the reflector housing 20 and lamp 14 to rotate together with the socket housing 18 with respect to ballast housing 12 through an angle of 180° around a horizontal axis, as shown in FIGS. 2 and 3. This rotational movement of lamp 14 simultaneously with the reflector housing 20 maintains the position of the lamp always optically correct vis-a-vis the reflector, irrespective of the orientation of the reflector.

Figure 4:
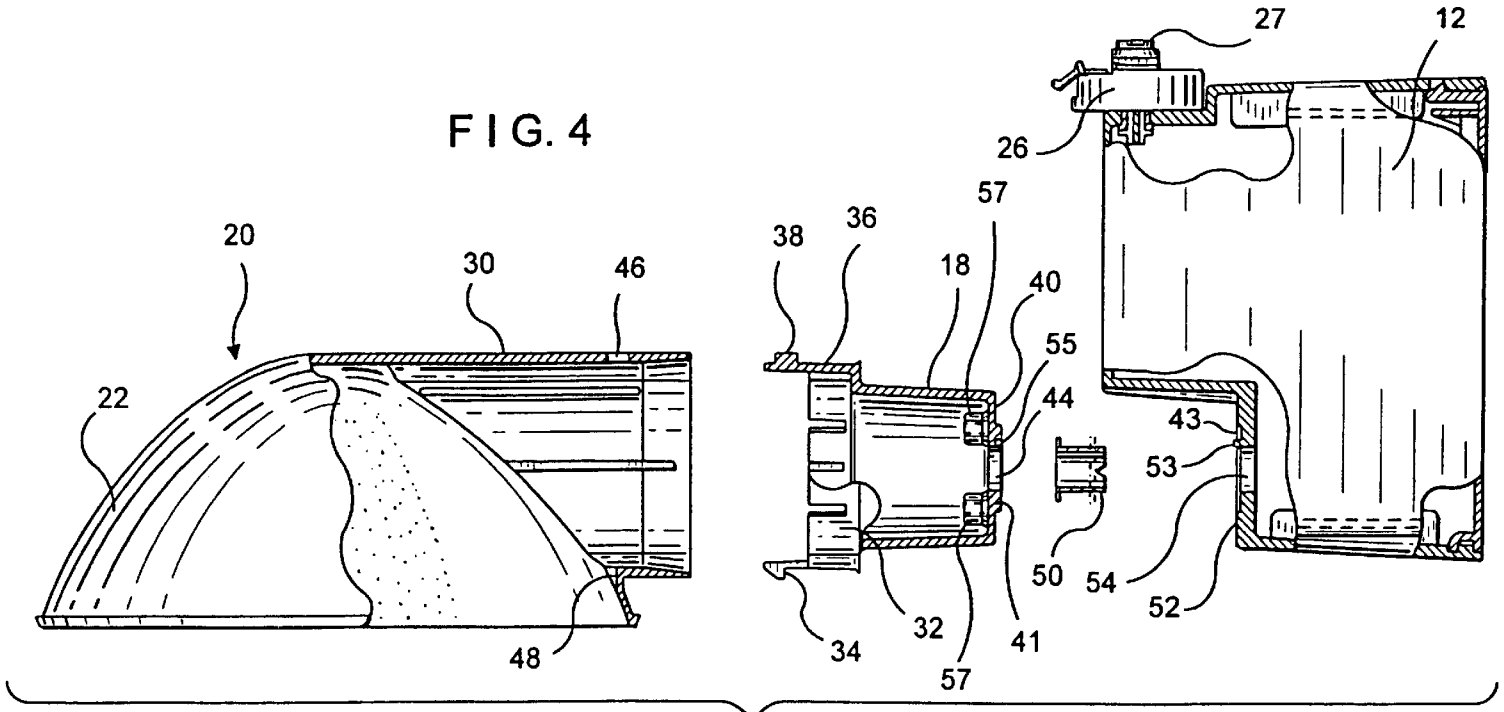
FIG. 4 is an exploded view, partly broken away, illustrating the construction of the swivel assembly for mounting the reflector and lamp to the ballast housing in the luminaire of FIG. 1.
Figure 5:
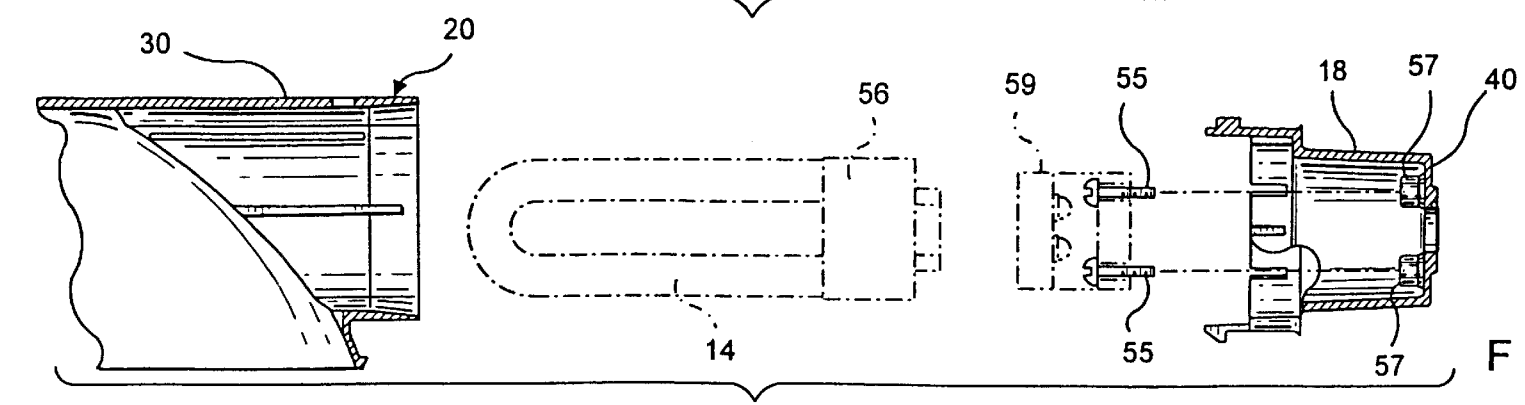
FIG. 5 is an exploded view, partly broken away, illustrating the manner in which the compact fluorescent lamp is secured to the socket housing.

The mounting of the reflector housing 20 to the ballast housing 12 to achieve the desired simultaneous rotation of reflector housing 20 and lamp 14 with respect to ballast housing 12 is illustrated in FIGS. 4 and 5. As therein shown, socket housing 18 includes a flange 32 at the end nearest the neck portion of reflector housing 20. Flange 32 may have a square shape that matches the shape and size of the neck portion of the reflector housing 20. Axially extending from flange 32 are a flexible finger 34 and a flexible extension 36 from which a button or tab 38 projects radially. Socket housing 18 includes an end wall 40 from which bosses 57 project into its interior. A central opening 44 surrounded by an annular raised section 41 is formed in end wall 40.

The neck portion 30 of reflector housing 20 includes an opening 46 of a comparable diameter to that of button 38, and a ledge portion 48. A eyelet 50 is positioned between the end wall 40 of the socket cup 30 and a recessed corner wall 52 of ballast housing 12. An opening 54 is formed in wall 52, around which a circular recess 43 is formed.

In its assembled condition, as shown in FIG. 5, the flange 32 of socket housing 18 is inserted and snap fit into the open end of reflector housing 20. Button 38 is received in opening 46, and the hooked end of finger 34 extends over ledge 48, thereby to secure reflector housing 20 to socket housing 18 in a nonrotational tight snap fit. The raised portion 41 of socket housing end wall 40 is received within the comparable diameter recess 43 formed in ballast housing wall 52. Raised section 41, and thus socket housing 18, is rotatable within recess 43 relative to the ballast housing about the axis of opening 54. That motion is limited by a stop 53 projecting from wall 52 adjacent recess 43 when it is received in an opening 35 in raised section 41 of the socket housing. One end of eyelet 50 is received within opening 44 in socket housing 18, and its other end is secured in opening 54 in wall 52 of ballast housing 12, to rotatably secure the socket housing to the ballast housing.

Figure 6:
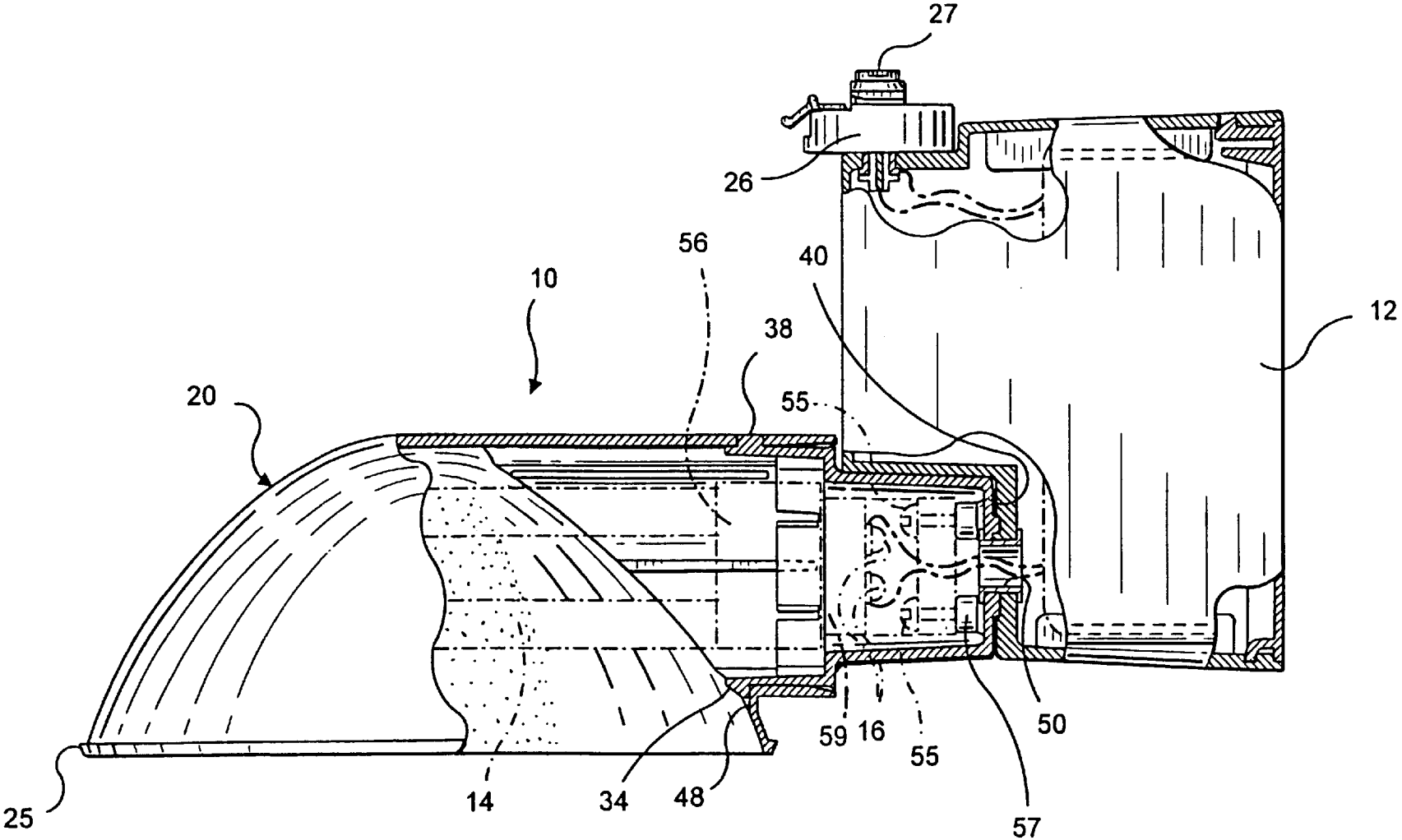
FIG. 6 is a view similar to FIG. 4 illustrating the assembled luminaire.

As shown in FIGS. 5 and 6, the ends of the fluorescent tubes 14 are received within a base 56, which is received within the neck portion of the reflector housing 20. Lamp base 56 is secured to a lamp holder 59, which, in turn, is secured to socket-housing 18 by means of screws 55 inserted into bosses 57 on end wall 40 of the socket housing.

As a result of the resulting tight snap fit between one end of the socket housing and the reflector housing, and the rotational attachment of the other end of the socket housing and the ballast housing, the reflector housing can be rotated about a horizontal axis through an angle of 180° relative to the ballast housing. Reflector housing 20 and lamp 14 can thus be pivoted as a unitary assembly relative to the ballast housing 12, thereby to maintain the desired alignment of the lamp 14 to the reflector housing 20 while allowing the light beam produced by lamp 14 to be aimed by such rotation of the reflector housing 20 to the desired angular orientation.

As noted previously, reflector housing 20 is optically designed to provide the desired symmetrical light pattern when lamp 14 is positioned along the horizontal axis of the reflector housing to expose the largest possible reflective surface area of the lamp 14 toward the reflective surface 24 and thereby obtain the most direct light output from the lamp 14 before it is reflected off reflective surface 24. It has been found that triple-tube compact fluorescent lamps, when placed in a reflector in such a horizontal position, generally create undesirable shadows or dark areas on the beam. To minimize this effect, in a further aspect of the invention, the inner reflective surface 24 of reflector housing 20 is divided into sections having different textures and thus different specularities.

In one preferred, but not limiting embodiment, the inner reflective surface 24 of reflector housing 20 is divided into four segments, two of which, segments 58 (FIG. 2) are stippled and are thus relatively semispecular, whereas the other two segments 60 are shiny or highly specular. Specular sections 60 maximize the light output, whereas the semispecular regions 58 disperse and mix, and thus diffuse, the incident light so as to fill the dark spots. The specular and semispecular segments 58, 60 may, as shown, be alternatively arranged about the inner surface 24 of the reflector housing 20. Segment 58, 60 may each subtend an angle of 90° and are preferably substantially equal in area. As shown in FIG. 2, segments 58, 60 terminate at their upper ends at a circular specular dome region 62 provided at the upper end of the reflector housing.

Figure 7:
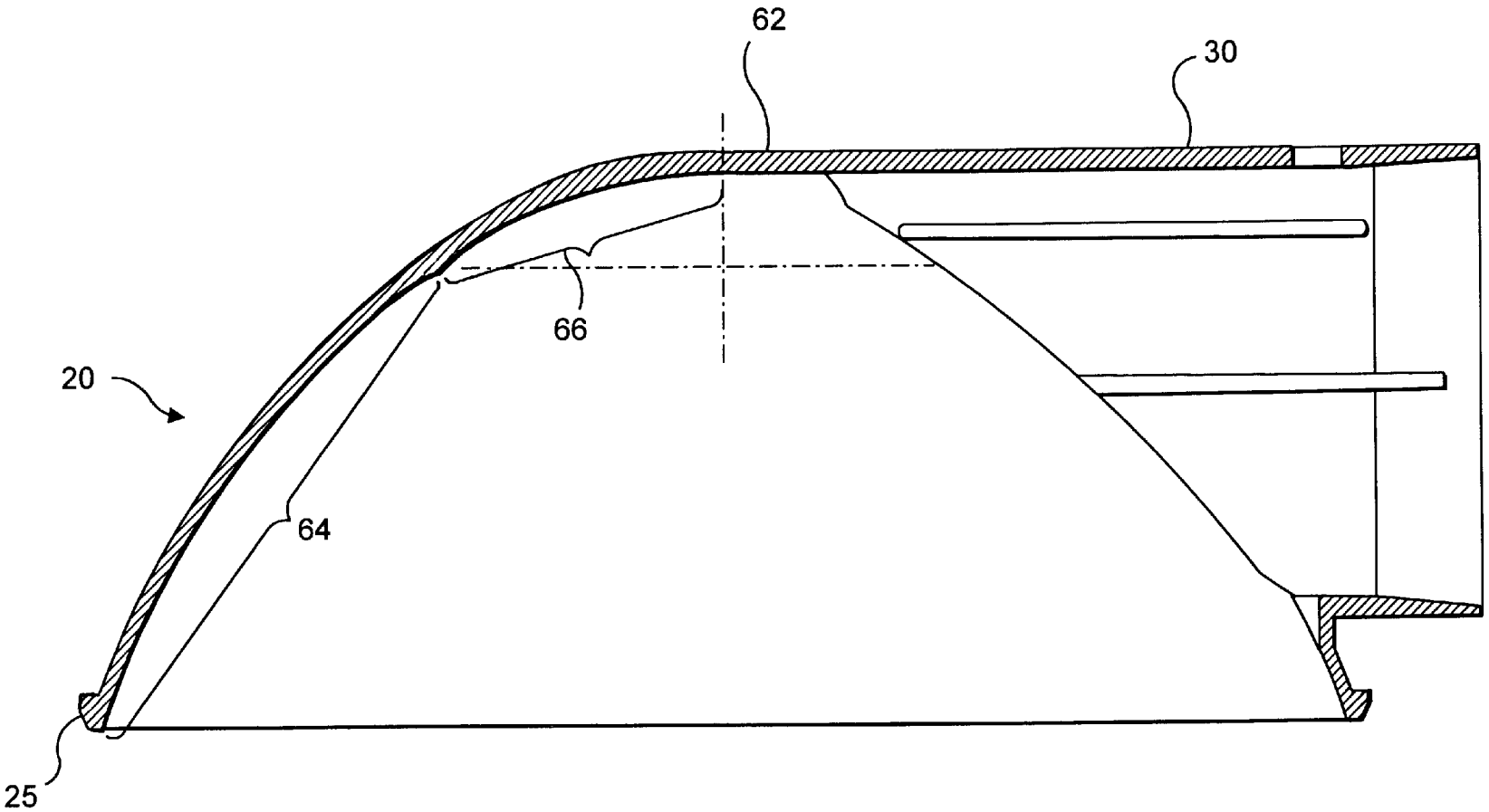
FIG. 7 is a side elevation of the reflector housing of the luminaire of FIG. 1.

As shown in FIG. 7, the reflector surface 24 includes, as viewed in a side elevation, a first parabolic segment 64 and a second, steeper parabolic segment 66 both of which terminate at their upper ends at dome region 62. The parabolic sections of segments 64, 66 are selected to achieve the desired focal point within the reflector for the fluorescent lamp 14.

It will be appreciated that the luminaire of the invention provides an effective and reliable structure for producing accent lighting with a compact fluorescent light source. It will also be appreciated that whereas the luminaire of the present invention has been described with respect to a presently preferred embodiments modifications may be made thereto without necessarily departing from the spirit and scope of the invention.

What is claimed is:

1. A luminaire comprising:

a reflector, a light source mounted in optical communication with said reflector and having its optical axis substantially parallel to the horizontal axis of said reflector, a ballast housing, means operatively cooperating with said reflector and said ballast housing for permitting repeated relative simultaneous rotational motion of said reflector and said light source relative to said ballast housing, said repeated relative motion permitting means including a socket housing snap fit at one of its ends into said reflector having a first wall section with a raised portion at its other end;

said ballast housing including a second wall section having a recess for receiving said raised portion, said raised portion being rotational within said recess.

2. The luminaire of claim 1 further comprising stop means on said ballast housing and said socket housing for limiting the extent of rotation of said socket housing relative to said ballast housing.

3. The luminaire of claim 1, in which said reflector includes an inner reflecting surface including at least one specular surface and at least one stippled surface in optical communication with said lamp.

4. The luminaire of claim 3, in which said reflector includes first and second specular surfaces, and first and second stippled surfaces interposed respectively between said first and second specular surfaces.

5. The luminaire of claim 4, in which said first and second specular surfaces are of a substantially equal surface area to that of said first and second stippled surfaces.

6. The luminaire of claim 5, in which said reflector housing is substantial parabolic in shape, and includes an upper dome section, said specular and stippled surfaces terminating at their upper ends at said dome section.

7. The luminaire of claim 6, in which said reflector housing includes a first section having a first parabolic shape and a said section having a second, different parabolic shape.

8. The luminaire of claim 7, in which said light source is a multi-tube fluorescent lamp.

* * * * *